United States Patent [19]

Gates, Jr.

[11] 4,343,625

[45] Aug. 10, 1982

[54] HIGH TEMPERATURE SOLIDS GASIFICATION APPARATUS WITH SLAG REDUCTION MEANS

[75] Inventor: Walter C. Gates, Jr., Carmel, N.Y.

[73] Assignee: Texaco Inc., White Plains, N.Y.

[21] Appl. No.: 225,881

[22] Filed: Jan. 19, 1981

[51] Int. Cl.[3] ..... B01J 3/00

[52] U.S. Cl. ..... 48/62 R; 48/77; 48/DIG. 2; 110/165 R; 110/216; 110/266

[58] Field of Search ..... 48/77, DIG. 2, 62 R, 48/215, 69, 207, 76, 92; 110/165 R, 266, 216; 266/154, 159, 157

[56] References Cited

U.S. PATENT DOCUMENTS

| | | | |
|---|---|---|---|
| 1,096,774 | 5/1914 | Whitfield | 48/76 |
| 2,699,384 | 1/1955 | Peery et al. | 48/69 |
| 3,951,615 | 4/1976 | Gernhardt et al. | 48/77 |
| 3,998,609 | 12/1976 | Crouch et al. | 48/215 |
| 4,043,766 | 8/1977 | Gernhardt et al. | 48/DIG. 2 |

FOREIGN PATENT DOCUMENTS

| | | | |
|---|---|---|---|
| 163198 | 10/1948 | Austria | 48/62 R |

*Primary Examiner*—S. Leon Bashore, Jr.
*Assistant Examiner*—Michael Goldman
*Attorney, Agent, or Firm*—Carl G. Ries; Robert A. Kulason; Henry C. Dearborn

[57] ABSTRACT

A high temperature solids gasification generator which employs finely divided solids, e.g. powdered coal, has a down flow and discharges into a plenum chamber below the generator. The plenum chamber has a restricted outlet at the bottom so that a pool of liquid slag will form, and there is a lateral outlet above the slag pool for effluent gas. The lateral outlet has its throat located offset farther from the axis of the plenum chamber than the inside radius of the chamber.

7 Claims, 7 Drawing Figures

11
HOT GAS, DRY
12
16
15
19
COOL GAS, WET
18
SLAG SLURRY

22
HOT GAS, DRY
34
5
36
37
23
27
35
31
STEAM
26
30
SLAG SLURRY

22'
41
HOT GAS, DRY
34'
6
42
40
23'
27'
35'
31'
STEAM
26'
30'
SLAG SLURRY

22''
41''
HOT GAS, DRY
7
35''
34''
31''
45
COOL GAS, WET
30''
SLAG SLURRY
23''
42''
50
40''
49
46
53

HIGH TEMPERATURE SOLIDS GASIFICATION APPARATUS WITH SLAG REDUCTION MEANS

BACKGROUND OF THE INVENTION

1. Field of the Invention

This invention concerns a high temperature solids gasification process in general and, more particularly, deals with structure for reducing the slag carry-over with the effluent gas from a plenum chamber that receives the outlet from the solids gasification generator.

2. Description of the Prior Art

There have been various structures employed and suggested for dealing with the outlet flow from high temperature solids gasification generators of the type where finely divided solids are being reacted. Such structures have been used for dealing with the effluent gases. However, the fact that liquid slag tends to accompany the generated gases in the outlet flow from the generator, tends to cause difficulty in the recovery of sensible heat from the effluent gases.

Consequently, it is an object of this invention to reduce the quantity of slag that is carried with the gases generated in a synthesis gas process using finely divided solids. The purpose is so that it is easier to recover the sensible heat from the synthesis gas which is generated.

SUMMARY OF THE INVENTION

Briefly, the invention concerns the combination with a high temperature solids gasification process that employs finely divided solids being reacted in a down flow generator and discharging liquid slag with gas products into a plenum chamber therebelow, of means for reducing the slag carry-over with the effluent gas from said plenum chamber. It comprises a restricted outlet at the bottom of said plenum chamber for causing a pool of liquid slag to form and assist in coalescence of said slag, and a lateral outlet above said pool of slag for carrying said effluent gas. The said lateral outlet has a throat thereof offset relative to the axis of said plenum chamber, a distance greater than the radius of said chamber, whereby said liquid slag carry-over is reduced.

Again briefly, the invention is in combination with a high temperature solids gasification process which employs finely divided solids being reacted in a down flow generator and discharging liquid slag with gas products into a plenum chamber therebelow. It has means for reducing the slag carry-over with the effluent gas from said plenum chamber, which comprises an impervious member coaxial with said plenum chamber and having a concave upper surface for holding a pool of liquid slag to assist in coalescence thereof. It also comprises an annular outlet passage at the edge of said pool for restricting flow and causing said pool to form, and a lateral outlet from said plenum chamber and located above said pool of slag for carrying said effluent gas. The said lateral outlet has a throat thereof offset relative to the axis of said plenum chamber a distance greater than the outside radius of said plenum chamber, whereby said liquid slag carry-over is reduced.

BRIEF DESCRIPTION OF THE DRAWINGS

The foregoing and other objects and benefits of the invention will be more fully set forth below in connection with the best mode contemplated by the inventor of carrying out the invention, and in connection with which there are illustrations provided in the drawings, wherein.

DESCRIPTION OF THE PREFERRED EMBODIMENTS

Figures 1, 2, 3, 4:
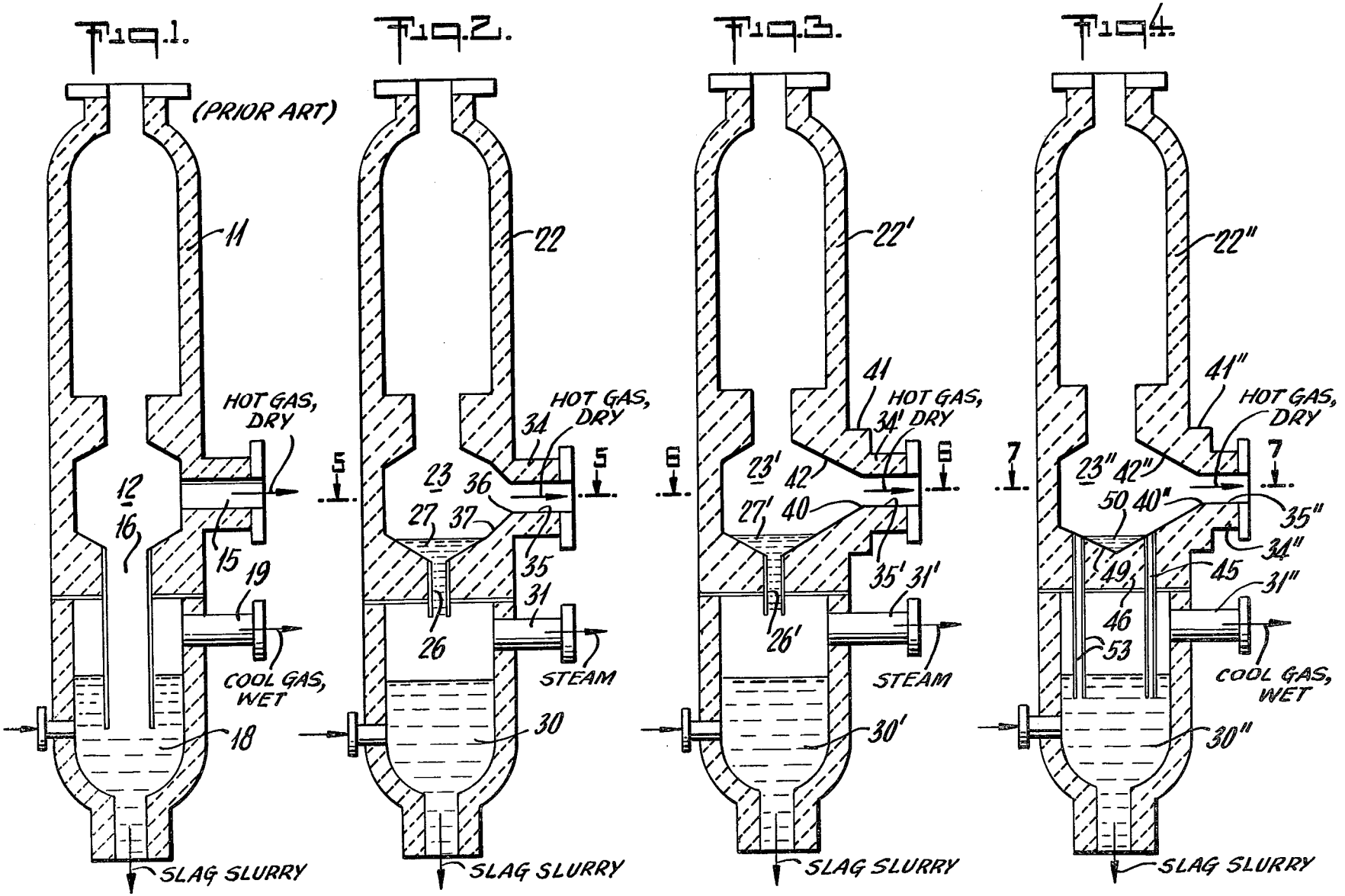
Fig. 1. (PRIOR ART)
FIG. 1 is a cross-sectional schematic representation showing one type of prior art structure.
FIG. 2 is a longitudinal, cross-sectional schematic showing one embodiment of the invention.
FIG. 3 is a longitudinal, cross-sectional schematic illustrating a different modification according to the invention.
FIG. 4 is still another longitudinal, cross-sectional schematic illustrating a further modification according to the invention.
Figure 5:
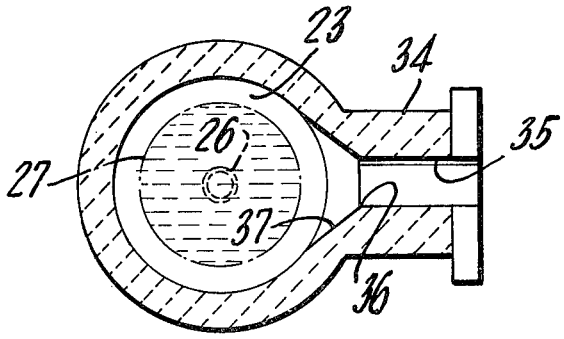
FIG. 5 is a transverse, cross-sectional view taken along the lines 5—5 of FIG. 2, and looking in the direction of the arrows.
Figure 6:
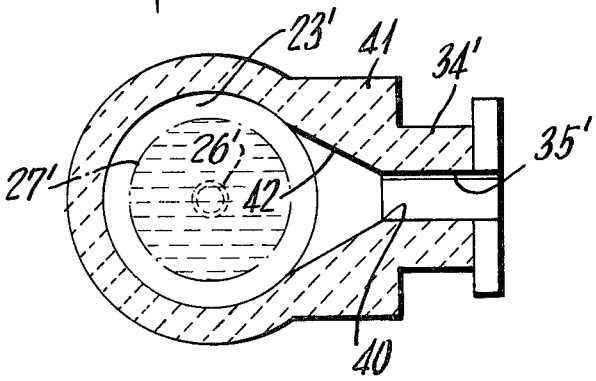
FIG. 6 is a transverse, cross-sectional view taken along the lines 6—6 of FIG. 3, and looking in the direction of the arrows.

FIG. 1 illustrates typical prior art structure where the procedure involves a down flow generator 11 in which a high temperature solids gasification process is carried out. The process employs finely divided solids, e.g. powdered coal, that is being reacted in the down flow generator 11 which discharges into a plenum chamber 12 beneath the generator. At the high temperatures employed, the procedure produces liquid slag with the gas products. In the prior art procedure the effluent stream was divided between two outlets 15 and 16 from the plenum chamber 12. The intention was to draw off hot gases that were dry, through the outlet 15 while having the remainder of the effluent stream flow down into a lower section 18 into which water was introduced so that there would be a slurry of slag and water formed while the gases in this stream would go up through the water and out through another outlet 19. That stream would then be in the form of cool wet gas, as indicated by the caption. However, it was found that such a division of effluent from the plenum chamber 12 was not as effective in reducing the amount of entrained liquid slag with the effluent gases through the outlet 15 as could be desired. Consequently, some studies were made using air and water droplets to simulate the action of separation of synthesis gas with entrained liquid slag as the outlet stream from a generator. It was discovered that certain modifications in the structure of the plenum chamber and its outlets were highly effective in reducing the carry-over of liquid slag with the hot gases from the generator.

It was determined from a review of pertinent correlations that the fluid properties of ambient air and water adequately simulated synthesis gas and slag, and a model was operated with gas velocities approximating those found in the type of synthesis gas generator of concern. Also, water was sprayed into the air stream to simulate liquid slag entrained with the synthesis gas. By operating the model, it was discovered that liquid carry-over could be reduced by having a pool of liquid to assist in coalescence of droplets, and by offsetting the throat of a lateral outlet from the axis of the chamber representing the plenum.

With reference to FIG. 2, it will be noted that the invention has two basic aspects in the ability to reduce the slag carry-over with the effluent gas. Thus, there is a generator 22 that discharges into a plenum chamber 23 at the bottom of which there is a restricted outlet 26. This outlet 26 has an effective cross sectional area such that the liquid slag that is entrained with the gas products from the generator 22, will form a pool 27 of liquid slag which continues to run out the lower end of the outlet 26 and drop into a quantity of water 30. There it forms a slag slurry with the water, and periodic removal of slag may be carried out through a lock hopper (not shown) in a conventional manner. It will be understood that the temperatures are such that the water will be heated and form steam which may exit through an outlet 31.

Another feature that reduces the slag carry-over with the effluent gas from the plenum chamber 23, is the structural relationship of the throat portion of a lateral outlet 34. Lateral outlet 34 has a substantially constant diameter nozzle section 35 with a throat 36 where it joins the plenum chamber 23. This throat 36 is offset relative to the axis of the plenum chamber 23 a distance which is greater than the radius of chamber 23. Thus, there is a frustoconical portion 37 between the throat 36 and the inside diameter of the plenum chamber 23. The simulated testing (noted above) confirmed that this arrangement provided a substantial reduction in the slag carry-over with the outlet gases from the generator 22.

FIG. 3 illustrates a modification of the invention as illustrated and described above in connection with FIG. 2. Since many of the elements are substantially the same in FIG. 3, the reference numerals will be used in accordance with the FIG. 2 showing, but with prime marks added. Thus, in FIG. 3 there is a generator section 22' that discharges downward into a plenum chamber 23' wherein, because of a restricted outlet 26', there is a pool 27' of liquid slag which forms and from which the slag flows down into a quantity of water 30' for removal in the form of a slag slurry, as explained above. An outlet 31' carries off the steam which is formed because of the temperature of the liquid slag.

In this modification, a lateral outlet 34' has a constant diameter nozzle portion 35', but in this instance there is a throat 40 where the nozzle 35' joins the plenum chamber 23'. This throat 40 is located offset considerably more than the throat 36 was from the center line of the plenum chamber 23, in the FIG. 2 embodiment. And, in order to accomplish this greater offset, there is a larger diameter collar 41 that connects the lateral outlet 34' with the walls of the plenum chamber 23'. In this case there is a frustoconical connection 42 between the throat 40 and the plenum chamber 23' which puts the throat 40 of the nozzle 35' at a radial distance from the axis of the plenum chamber 23' that is greater than the outside radius of chamber 23'.

FIG. 4 illustrates still another modification of the invention which in this case retains many of the structural attributes of FIGS. 2 and 3. Consequently, in this instance the same reference numerals will be employed for the same parts, but using a double primed notation. A generator 22'' has its outlet connected to a plenum chamber 23'' that has a lateral outlet 34'' with a nozzle section 35''. A collar 41'' connects the outlet 34'' with the walls of the plenum chamber 23''. It accommodates a throat 40'' that is connected to the plenum chamber 23'' via a frustoconical connecting surface 42''.

In this modification, the restricted outlet takes the form of an annular outlet passage 45 that surrounds an impervious member 46 that is coaxial with the plenum chamber 23''. There is a concave upper surface 49 on the member 46, that holds a pool 50 of liquid slag. This pool of liquid slag 50 tends to assist in coalescence of the slag droplets being carried by the effluent gases from the generator 22''. Excess liquid slag from the pool 50 will run over the edges of the concave upper surface 49 and down through the annular outlet passage 45. The passage 45 may have a double walled extension 53 that will carry the liquid slag from the pool 50 down into a body of water 30''. In this case, some of the effluent gas in the plenum chamber 23'' may go down with flowing liquid slag through the annular passage 45. And, any such gas will then flow through the water 30'' to an outlet 31'' and out with the steam that is formed by the hot slag.

Figure 7:
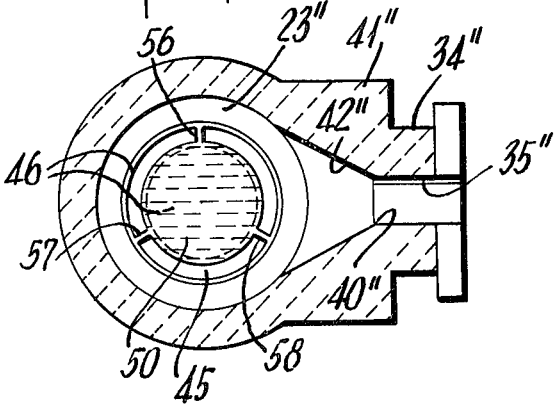
FIG. 7 is a transverse, cross-sectional view taken along the lines 7—7 of FIG. 4, and looking in the direction of the arrows.

It will be understood from the FIG. 7 illustration that the impervious member 46 may be supported in any feasible manner to hold it in its coaxial location relative to the plenum chamber 23''. Thus, as shown in FIG. 7, there are three support legs 56, 57 and 58 that connect the impervious member 46 with the lower body of the plenum chamber 23''.

While particular embodiments of the invention have been described above in considerable detail in accordance with the applicable statutes, this is not to be taken as in any way limiting the invention but merely as being descriptive thereof.

I claim:

1. In combination with a high temperature solids gasification apparatus where finely divided solids are reacted in a down flow generator and liquid slag with gas products are downwardly discharged from said generator through a constriction and into a plenum chamber therebelow, said plenum chamber having an inside and an outside radius, means for reducing the slag carry-over with the effluent gas from said plenum chamber, comprising a restricted outlet at the bottom of said plenum chamber for causing a pool of liquid slag to form and assist in coalescence of said slag, and a lateral outlet from said plenum chamber and located above said pool of slag for carrying said effluent gas, said lateral outlet having a frusto conical portion connecting said plenum chamber to a nozzle section of said lateral outlet and narrowing from said plenum chamber to form a throat at the intersection of the frustro conical portion and said nozzle, said throat being offset relative to the vertical axis of said plenum chamber a distance greater than the inside radius of said plenum chamber, whereby said liquid slag carry-over is reduced.

2. The invention according to claim 1, wherein said throat offset is at least substantially as far as the outside radius of said plenum chamber.

3. The invention according to claim 2, wherein said throat offset is greater than the outside radius of said plenum chamber.

4. The invention according to claim 3, wherein said restricted outlet comprises an impervious member coaxial with said plenum chamber for holding said pool of liquid slag, and an outlet passage at the edge of said pool.

5. The invention according to claim 4, wherein said outlet passage is annular.

6. The invention according to claim 5, wherein said impervious member has a concave upper surface.

7. In combination with a high temperature solids gasification apparatus where finely divided solids are reacted in a down flow generator and liquid slag with gas products are downwardly discharged from said generator through a constriction and into a plenum chamber therebelow, said plenum chamber having an inside and an outside radius, means for reducing the slag carry-over with the effluent gas from said plenum chamber, comprising an impervious member coaxial with said plenum chamber and having a concave upper surface for holding a pool of liquid slag to assist in coalescence thereof, an annular outlet passage at the edge of said pool for restricting flow and causing said pool to form, and a lateral outlet from said plenum chamber and located above said pool of slag for carrying said effluent gas, said lateral outlet having a frusto conical portion connecting said plenum chamber to a nozzle section of said lateral outlet and narrowing from said plenum chamber to form a throat at the intersection of the frusto conical portion and said nozzle, said throat being offset relative to the vertical axis of said plenum chamber a distance greater than the outside radius of said plenum chamber whereby said liquid slag carry-over is reduced.

* * * * *